US006607002B2

(12) United States Patent
Reese

(10) Patent No.: US 6,607,002 B2
(45) Date of Patent: Aug. 19, 2003

(54) PORTABLE SUNSHADE

(76) Inventor: Ben Reese, 20777 Mountain Dr., San Jose, CA (US) 95101

( * ) Notice: Subject to any disclaimer, the term of this patent is extended or adjusted under 35 U.S.C. 154(b) by 0 days.

(21) Appl. No.: 10/187,918

(22) Filed: Jul. 1, 2002

(65) Prior Publication Data

US 2002/0174887 A1 Nov. 28, 2002

Related U.S. Application Data

(62) Division of application No. 09/860,093, filed on May 16, 2001, now Pat. No. 6,412,506, which is a division of application No. 09/536,884, filed on Mar. 28, 2000, now Pat. No. 6,305,394.

(51) Int. Cl.[7] ..... E04H 15/06; A45B 11/00

(52) U.S. Cl. ..... 135/88.08; 224/519; 224/521

(58) Field of Search ..... 135/88.08, 88.05, 135/88.13; 296/163; 224/519, 531, 521

(56) References Cited

U.S. PATENT DOCUMENTS 706,605 A * 8/1902 Slyder
2,508,757 A * 5/1950 Gray
3,055,381 A * 9/1962 Zielinski
3,383,814 A * 5/1968 Rowe
4,519,409 A * 5/1985 Kinney et al.
5,116,258 A * 5/1992 Vennik
5,232,005 A * 8/1993 Mitchell
5,752,639 A * 5/1998 Rice
5,850,843 A * 12/1998 Mahood et al.
5,857,741 A * 1/1999 Anderson
5,937,882 A * 8/1999 Harbaugh
5,950,617 A * 9/1999 Lorenz
6,082,269 A * 7/2000 Padberg
6,189,458 B1 * 2/2001 Rivera
6,305,394 B1 10/2001 Reese
6,314,891 B1 * 11/2001 Larson
6,412,506 B1 7/2002 Reese

* cited by examiner

*Primary Examiner*—Robert Canfield
(74) *Attorney, Agent, or Firm*—Donald R. Boys; Central Coast Patent Agency Inc.

(57) ABSTRACT

Disclosed herein is a portable sunshade comprising a mast structure extending in a generally vertically direction, means for attaching the mast structure at its lower end to a support structure, a boom extending outwardly from the mast structure, having first and second ends, the first end being movably attached to the mast structure, a hub assembly attached to the second end of the boom, a plurality of elongated support ribs extending radially from the hub assembly, each of said support ribs, having one end rotatably attached to the hub assembly, a canopy positioned over the elongated support ribs and fastened thereto, the canopy having an opening in it corresponding to a predetermined position along the boom, and a boom support strut pivotably attached at one end to the upper end of the mast structure, and at the other end pivotably secured to boom at a predetermined position along the length of it, the boom support strut extending through the opening in the canopy at the point where it is connected to the boom.

8 Claims, 19 Drawing Sheets

PORTABLE SUNSHADE

CROSS-REFERENCE RELATED DOCUMENTS

The present patent application is a Divisional application of Ser. No. 09/536,884 filed Mar. 28, 2000, now U.S. Pat. No. 6,305,394, issued Oct. 23, 2002, which is a Divisional of Ser. No. 09/860,093, filed May 16, 2001, now U.S. Pat. No. 6,412,506, issued Jul. 2, 2002. The prior U.S. Patents are incorporated herein in their entirety by reference.

BACKGROUND OF THE INVENTION

1. Field of the Invention

This invention relates to an umbrella like sunshade. More particularly, it relates to a lightweight portable sunshade that can be moved around to various locations with relative ease.

2. Relevant Art

Sunshades are known in the art. Most sunshades, at least or the large variety, are relatively stationary, and require a heavy base to support the umbrella like cover or canopy that most of them conventionally use. Sunshades are used around pools, at the beach and elsewhere in tropical countries, in particular, to block out the rays of the sun during the heat of the day.

A typical sunshade comprises a large cover or canopy, supported by a frame consisting of movable struts or ribs, connected to a boom which can be tilted at various angles around a stationary support or pole. The pole is typically mounted in a heavy cement block at its lower end or base, so that in high winds the sunshade does not tip over and injure those who may be sitting under it. Thus, up until now, a large sunshade has been, out of necessity, more or less stationary.

There is a need, however, for large portable sunshades, which can be moved around with ease. Campers, and travel trailer owners, in particular, would like to have a sunshade which can be moved around, set up and torn down, without a lot of hassle. Camping in the desert is a popular pastime in the West, and sunshades are definitely useful in the desert where there is little if any shade.

SUMMARY OF THE INVENTION

It is an object of this invention to provide a lightweight portable sunshade, which can be folded up and moved around with a minimum of difficulty.

It is a further object of this invention to provide a sunshade that can be tilted and rotated at various angles, to block out the sun, and which does not require a large stationary base to support it.

Other objects of the invention will be realized by reference to the description below.

In accordance with the above objects and those that will be mentioned and will become apparent below, the portable sunshade in accordance with this invention comprises:

a mast structure extending in a generally vertical direction, means for attaching said mast structure at its lower end to a support structure, a boom extending outwardly from said mast structure, having first and second ends, said first end being movably attached to said mast structure, a hub assembly attached to said second end of said boom, a plurality of elongated support ribs extending radially from said hub assembly, each of said support ribs having one end rotatably attached to said hub assembly, a canopy positioned over said plurality of elongated support ribs and fastened thereto, said canopy having an opening in it corresponding to a predetermined position along said boom, and a boom support strut pivotably attached at on end to the upper end of said mast structure, and at the other end pivotably secured to said boom at a predetermined position along the length of it, the boom support strut extending through said opening in said canopy at the point where it is connected to said boom.

The present invention, in one embodiment, is a portable sunshade which comprises a base having a horizontally extending plate that a weight can to placed on to provide support for the upper portion of the sunshade, a mast extending vertically from the base, a movable boom extending outwardly from the mast connected to a hub at its outer end, support ribs radially extending from the hub situated at the outer end of the boom, a canopy overlying and connected to the support ribs, and a boom support strut extending from the top of the mast to the boom to provide support for the hub and ribs, and the canopy spanning the ribs.

In another embodiment, the sunshade of the invention is adapted to be used in connection with a utility rack or other extension which is conventionally found attached to the rear of a vehicle such as an SUV, a truck, or automobile.

BRIEF DESCRIPTION OF THE DRAWING

FIG. 9 is a perspective view or portions of the hub mechanism showing the relationship of the hub mechanism plates with the rotatable rib plugs placed there between.

FIG. 11 is a detailed view of the hub mechanism plates with rib plugs interposed there between.

DETAILED DESCRIPTION OF THE INVENTION

Figure 1:
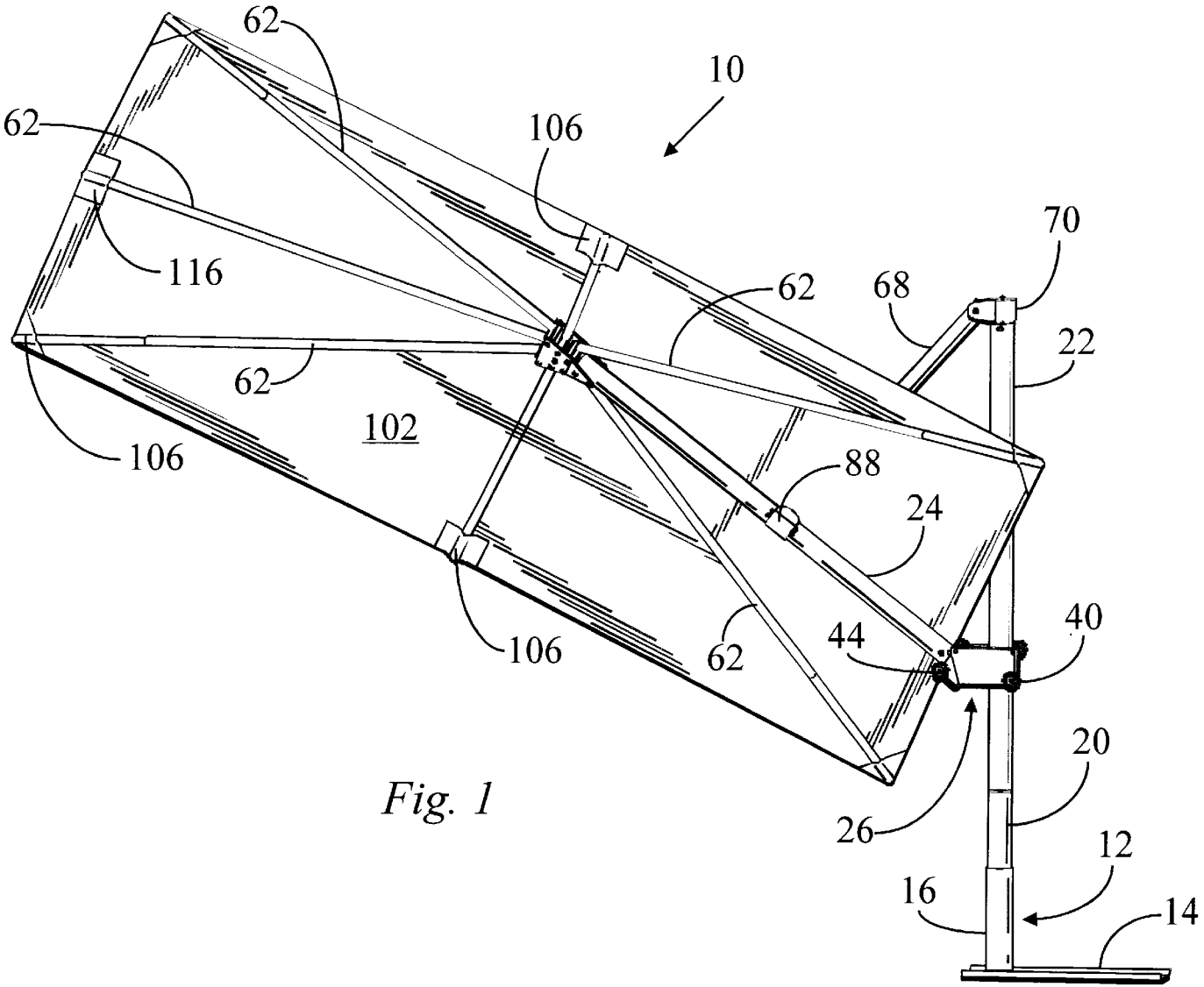
FIG. 1 is a side view of one embodiment of the sunshade of the invention, showing the underside of the canopy and supporting ribs for the canopy connected to a hub.
Figure 2:
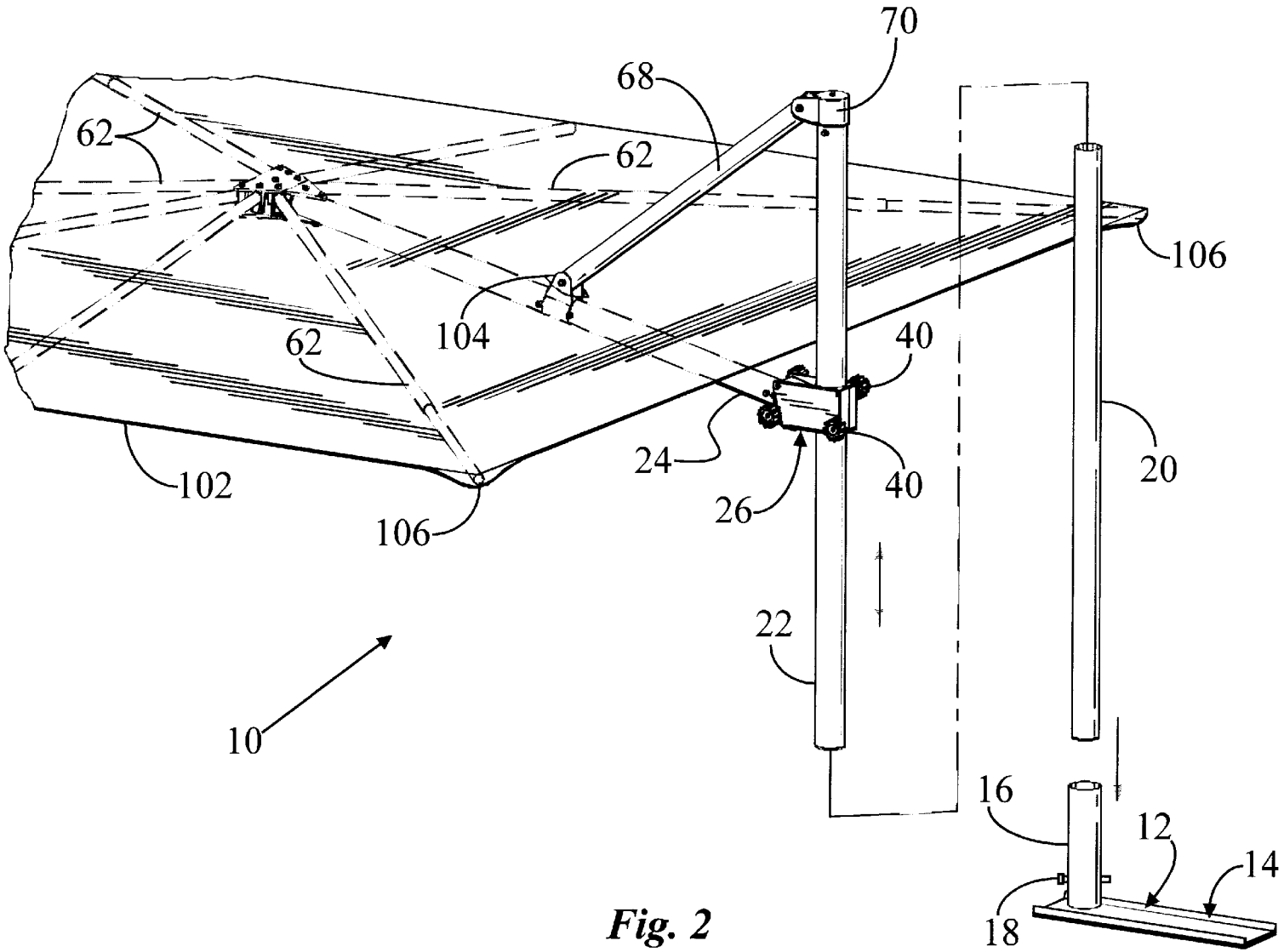
FIG. 2 is a side view, with parts shown in phantom, and parts broken away, of one embodiment of the sunshade of the invention.

In one embodiment of the invention, as best seen in FIGS. 1–3, and 12, the portable sunshade of this invention 10 comprises a base member 12 consisting of a horizontal support frame, or plate 14 upon which is fixed a vertically extending tubular column 16. The tubular column 16 has a bolt 18 (FIG. 12) extending transversely through it a distance from the horizontal base plate 14.

The horizontal support frame or plate 14 can be of any reasonable length and width, but should be of sufficient length and width so that the wheels of a car or truck, or other vehicle can rest on it, without the vertical components of the sunshade scraping the sides of the vehicle. Generally, therefore, the plate 14 should be from 2 to 3 feet in length. The preferred length is about 3 feet. The width is preferably about 20 inches.

The support frame 14 should be sufficiently strong to withstand the weight of an auto, truck, or trailer, which is used to provide stability for the sunshade unit.

In an alternative embodiment, the plate 14 is slipped under the edge of a hot tub, and the hot tub provides the necessary weight to prevent the sunshade from tipping over.

The support frame or horizontal plate 14 can be made of any material such as iron, steel, or aluminum, but should be sufficiently sturdy that it will not bend when the wheel of an auto, truck or other vehicle is resting on top of it, yet light enough so that it can be transported with relative ease. An iron or steel plate, at least ¼ inch thick, has been found to be sufficient for the purpose.

The column 16 can also be fabricated of iron, steel, or aluminum, but it too, should be sufficiently sturdy so as not to break or bend due to the weight of or forces brought to bear by the rest of the sunshade. Preferably, the tubular column 16 is made of stainless steel, is 3 inches in external diameter, and 2¾ inches in internal diameter. The column 16 is preferably welded to the support frame or horizontal plate 14, but it can be affixed in any other suitable manner, such as bolting.

A lower mast 20 is telescopically mounted on the tubular column 16. The mast 20 fits within the tubular column 16, and is slideable in relation thereto for height adjustment. The external diameter of the mast 20 is slightly less than the internal diameter of the tubular column 16 so that the lower end of the mast 20 securely fits into and is slideable within the column 16.

An upper or main mast 22 is telescopically fitted over the mast 20. The internal diameter of the main mast 22 is slightly larger than the external diameter of the mast 20 so that the main mast 22 can slide up and down on mast 20 as adjustments are made in its height.

Preferably, the external diameter of the mast 20 is 2¾ inches, while the internal diameter of the main mast 22 is about 3 inches.

The mast 20 and main mast 22 can be made of any suitable material such as iron, steel, plastic composite materials, or aluminum, but aluminum is preferred because of its lighter weight and durability.

Figure 3:
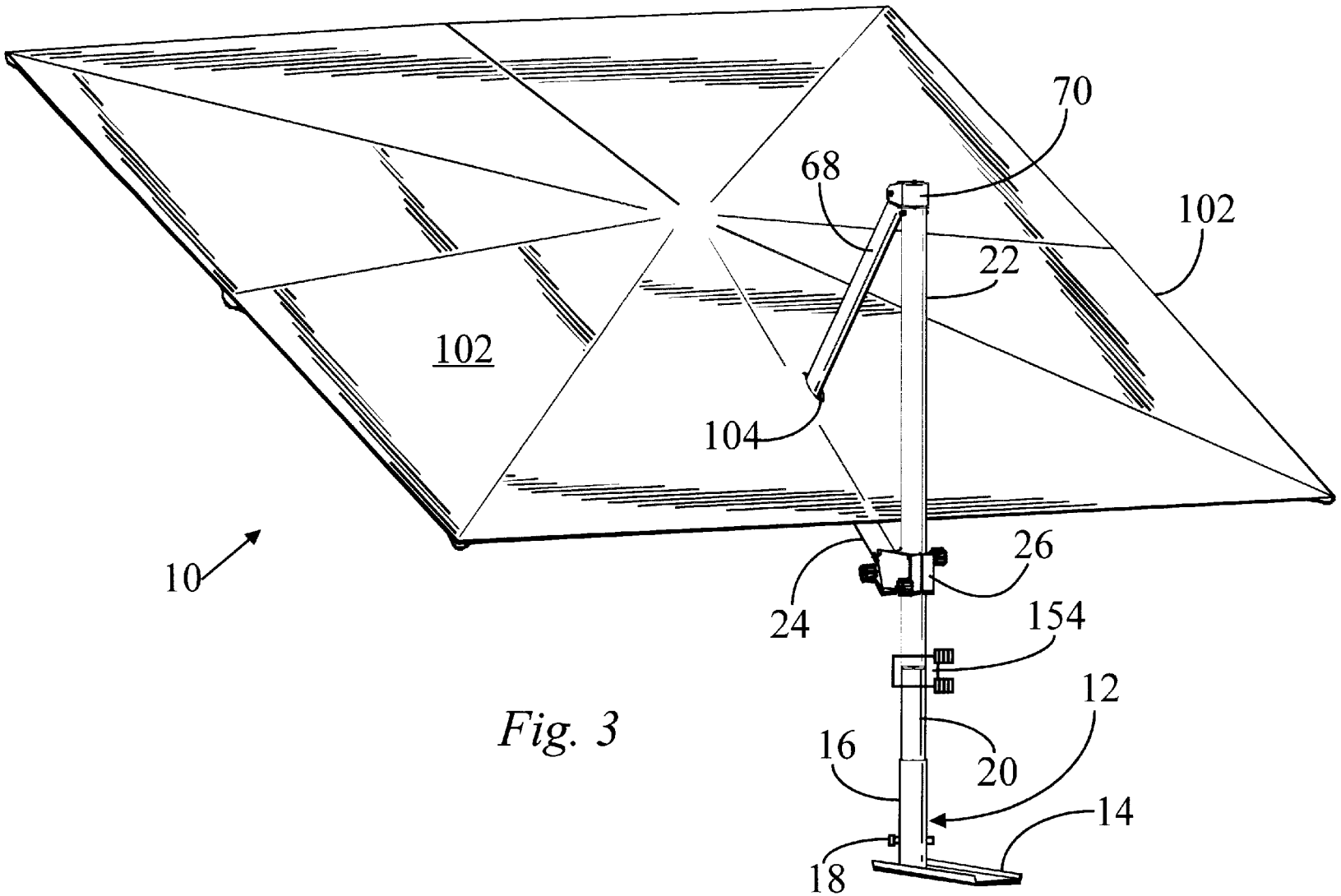
FIG. 3 is a view of the top surface of the canopy of the sunshade of the invention illustrating the relationship between the support structure and the canopy when in extended position.
Figure 17:
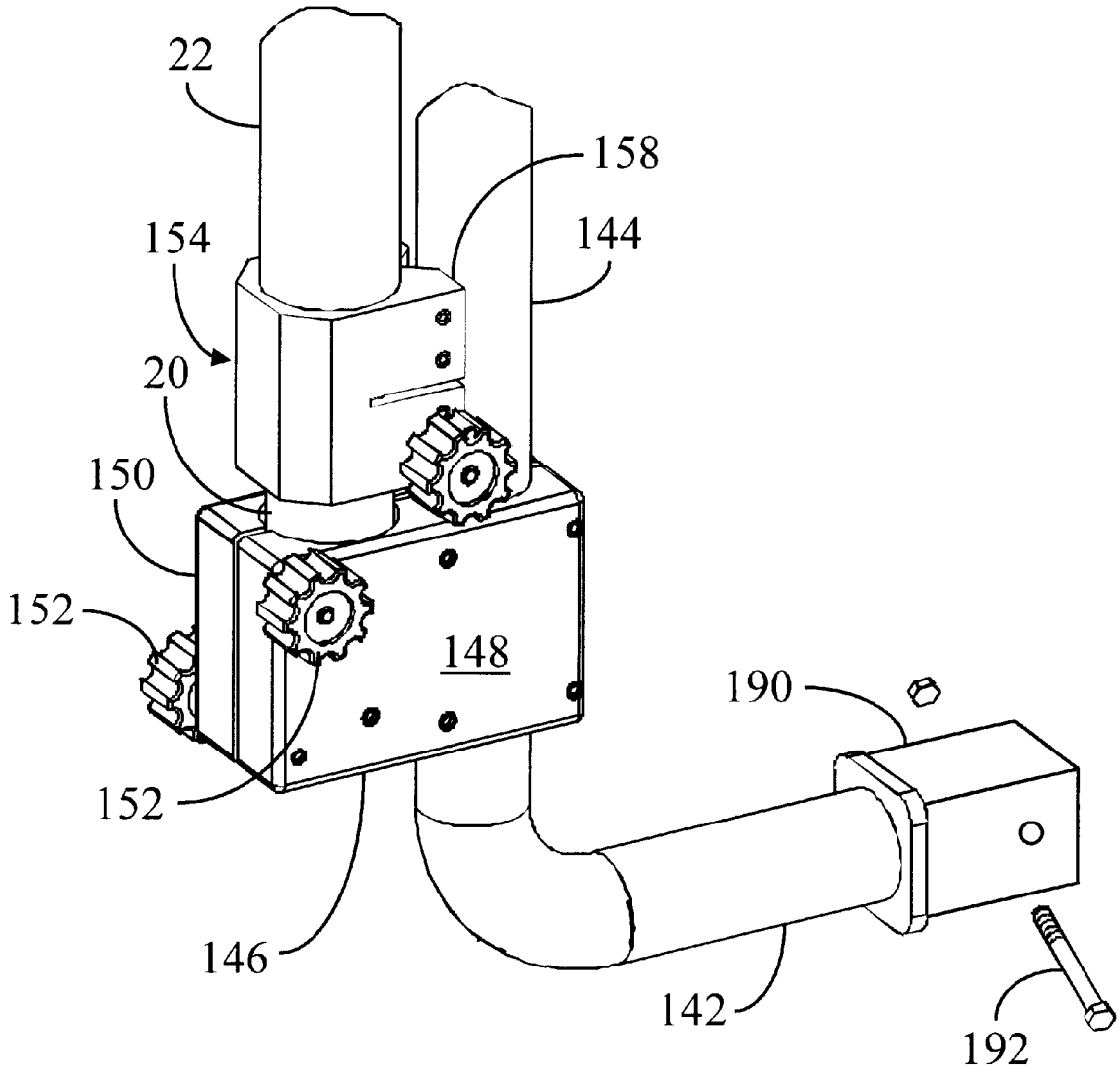
FIG. 17 is a perspective view of the clamping means for connecting one embodiment of the sunshade of the invention to a utility rack or other attachment to a vehicle, and also showing the means of attaching it to a trailer hitch or towing receiver.
Figure 18:
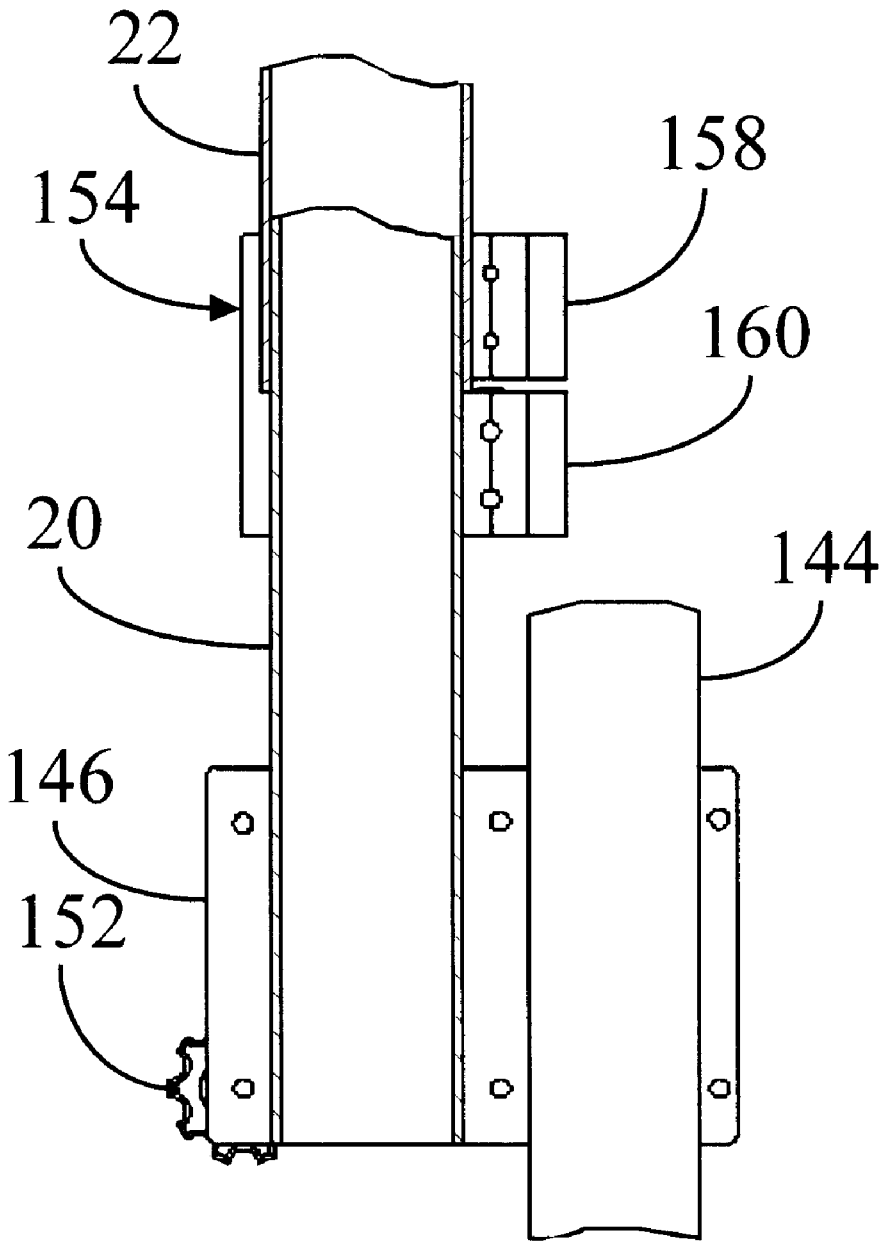
FIG. 18 is a cross sectional view through line 18—18 of FIG. 17.

As seen in FIGS. 3, 17 and 18, a clamp 154 is used to fix the position of the main mast 22 on the lower mast 20. The operation of the clamp is explained in more detail, infra.

A hollow tubular boom 24 is movably and rotatably attached to the main mast 22 and extends outward therefrom.

Figure 7:
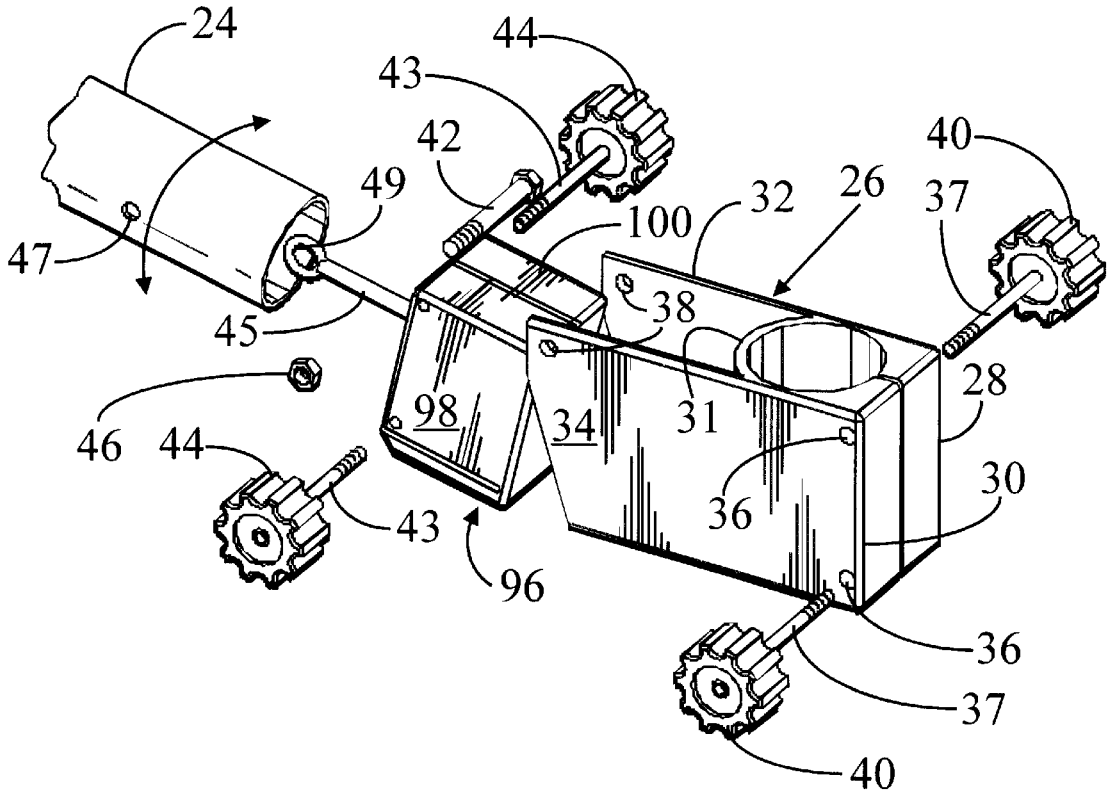
FIG. 7 is a perspective view of the clamping mechanism for positioning the boom on the main mast.

As best seen in FIG. 7, the boom 24 is attached at its near end to the main mast 22 by means of a sliding mast clamp or collar 26 that fits around the main mast 22. The mast clamp 26 is a unitary machined or molded piece, and consists of opposing plates 28 and 30, each of which is shaped, in its inner surface, to conform to the outer surface of the main mast 22. The plates 28 and 30 are connected together by a web 31 at one end, and spaced apart from each other at the other end by a slit. Each of the plates 28 and 30 has ear extensions 32 and 34, that project horizontally away from the main mast 22. The plates 28 and 30 each have holes 36 in them, which align when the plates are positioned opposite each other around the main mast 22. Compression bolts 37 are positioned in each of the holes 36, extending through both plates 28 and 30, from opposite directions.

The ears 32 and 34 also have holes 38 in them that align when the plates 28 and 30 are opposite each other surrounding the main mast 22.

The opposing plates 28 and 30 are tightened around the main mast 22 by compression nut knob handles 40, which are threaded around the projecting ends of the compression bolts 37. The plates 28 and 30 are drawn toward each other as the knobs 40 are tightened.

The sliding mast clamp 26's position on the main mast 22 can thus be adjusted by moving it up or down on the mast 22 and tightening the compression bolts 37 with the knobs 40 when the desired position is achieved.

The boom 24 is pivotably affixed to the clamp mechanism 26 by placing the near end of it between a collar 96 comprising opposing plates 98, and 100. The collar 96 fits between the opposing ears 32 and 34 of the plates 28 and 30. The opposing plates 98 and 100 of the collar 96 are drawn together by opposed compression bolts 43 threaded through the plates with compression bolt tightening knobs 44 positioned at the ends thereof. The inside surfaces of the plates 98 and 100 are shaped so that each conforms to the shape of ½ the surface of the boom 24.

The boom 24 is placed between the opposing plates 98 and 100 and is secured to the collar 96 by means of an eye bolt 45 secured at one end to the collar 96, and at the other end by a bolt (not shown) which extends through a hole 47 in the boom 24, and the eye 49 of the eyebolt 45 that projects into the cavity of the boom 24.

A bolt 42 extending through the holes 38 and through the collar 96, secures the collar 96 in place, and thus allows the boom 24 to pivot about the main mast 22 in a vertical direction. A nut 46 secures the bolt 42. The collar 96 is thus rotatably fixed between the opposing ears 32 and 34 of the collar mechanism 26.

Thus the boom 24 is rotatable around a horizontal axis, and pivotable with respect to the main mast 22 in a vertical direction.

The boom 24 can be rotated about its axis by loosing the knobs 44 on the compression bolts 43. After the boom 24 is rotated to the desired degree, the knobs 44 are tightened again, fixing the boom 24 in its new position.

Figure 6:
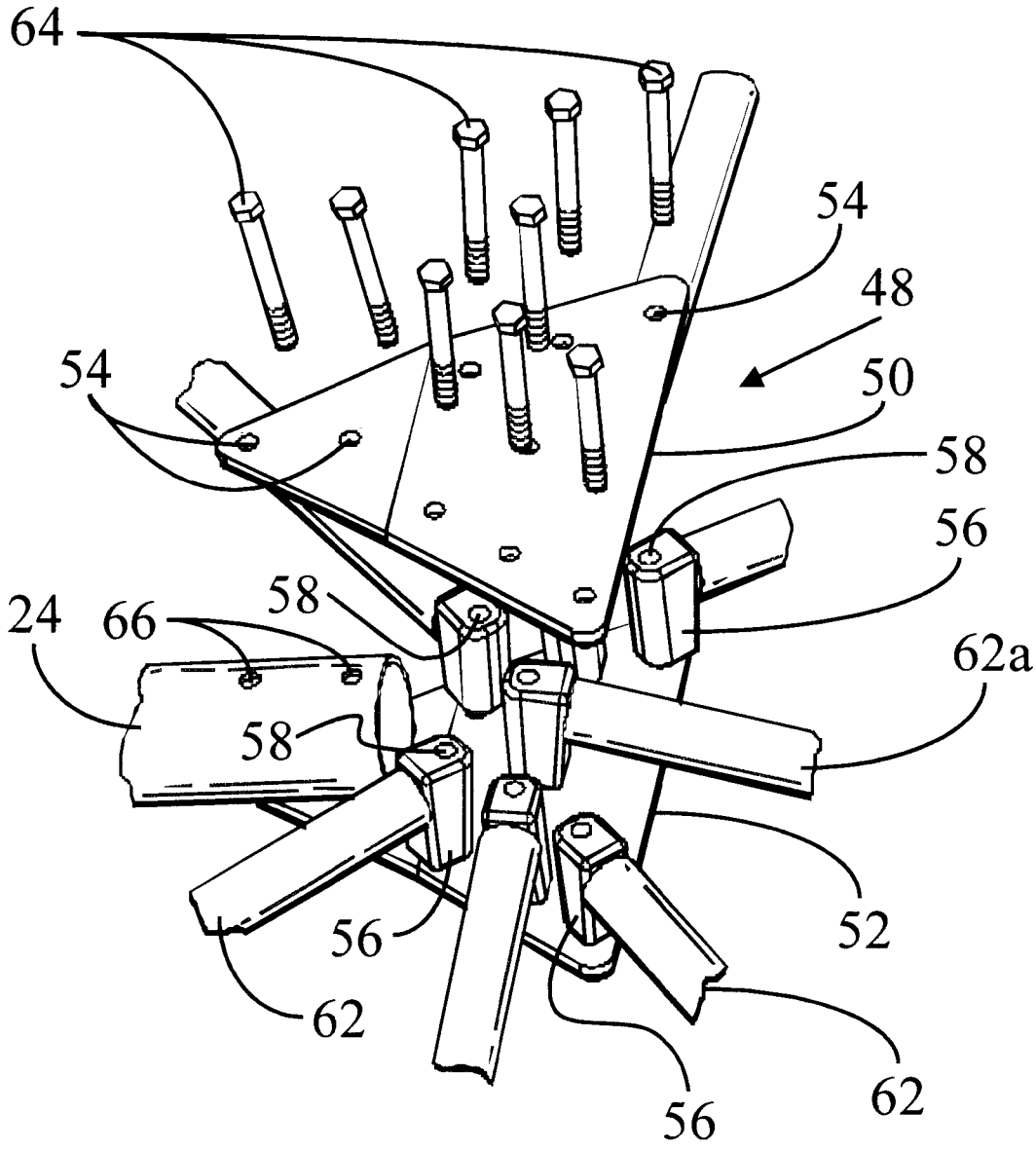
FIG. 6 is an exploded view of the hub mechanism of the sunshade of the invention.
Figure 9:
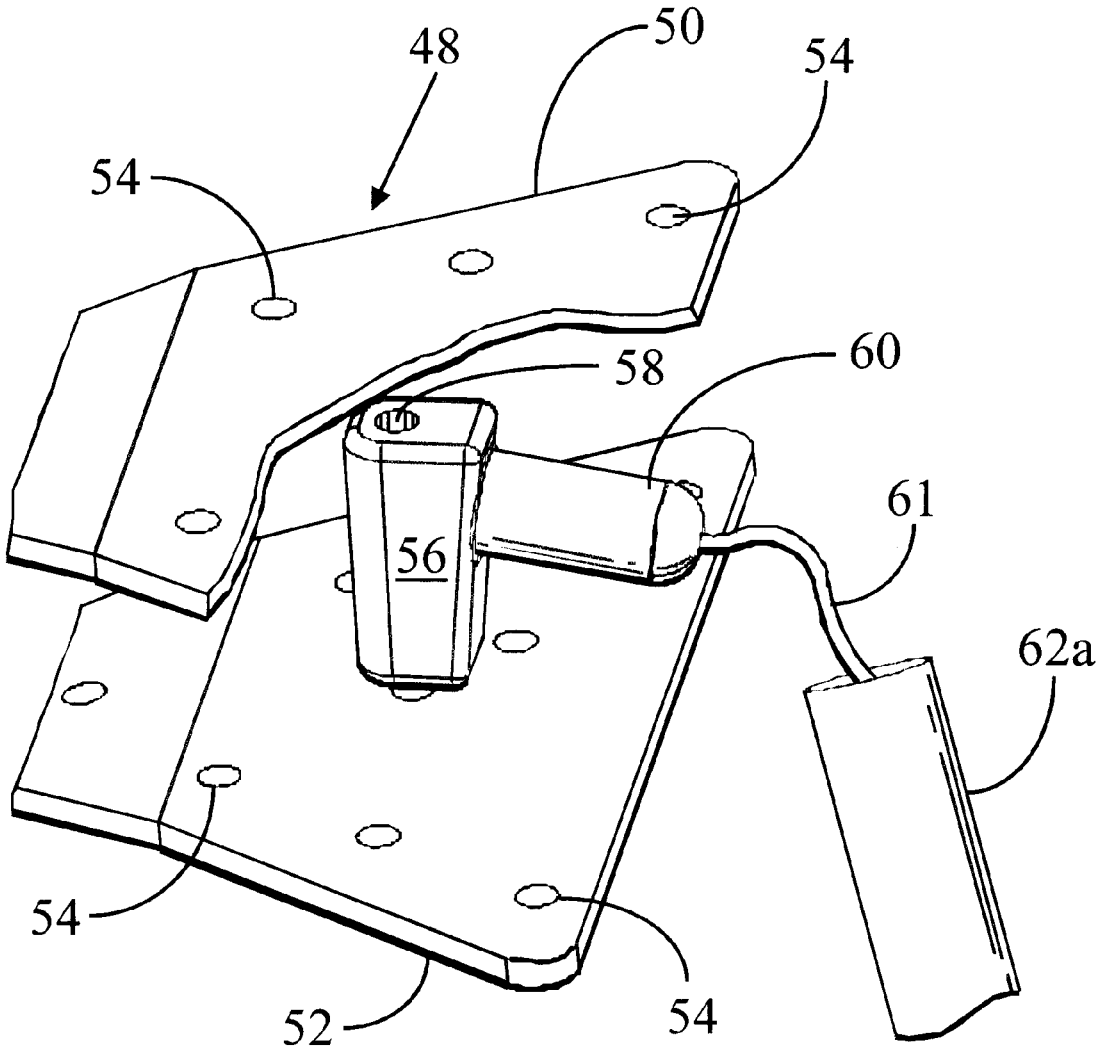
Figure 11:
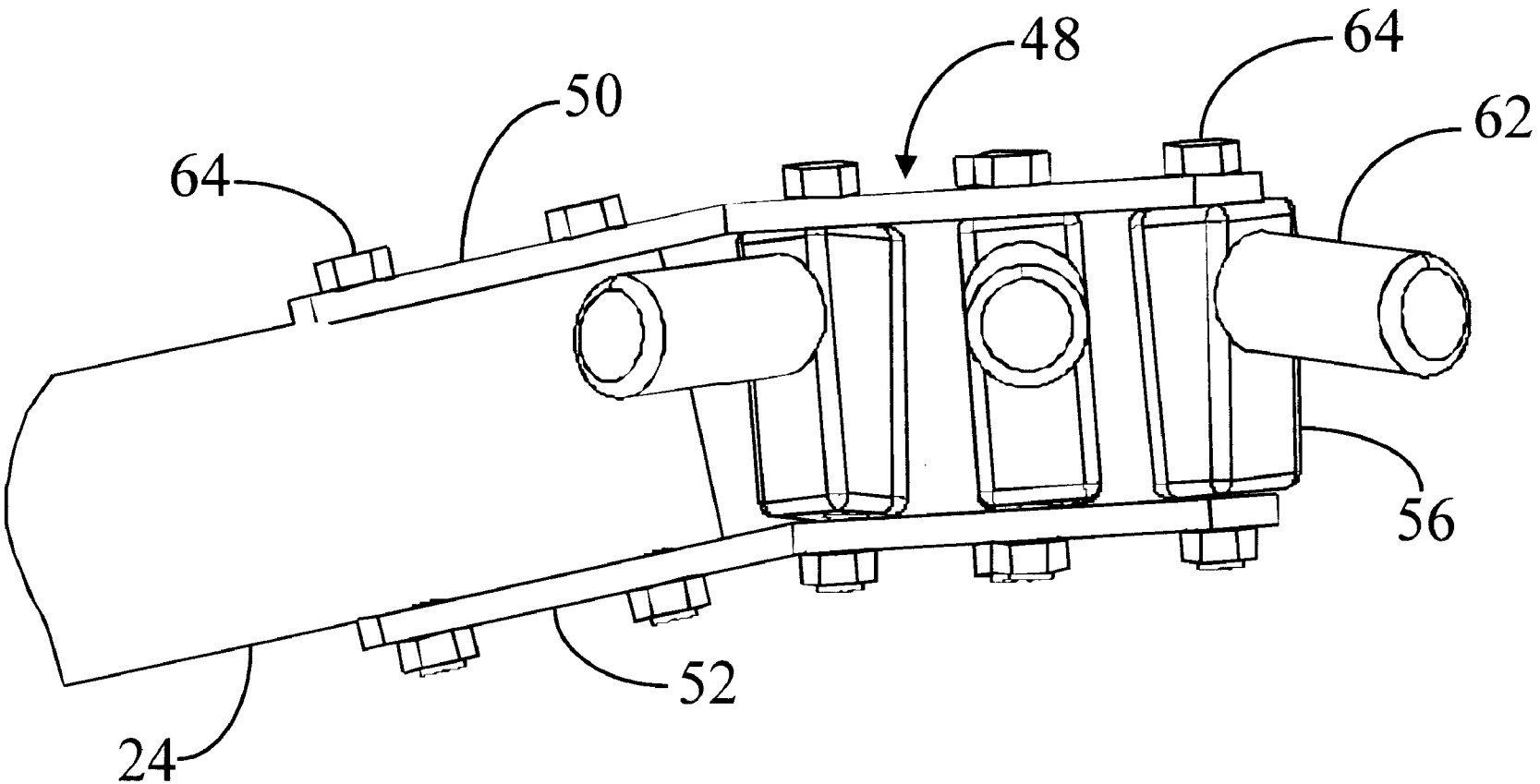
Figure 12:
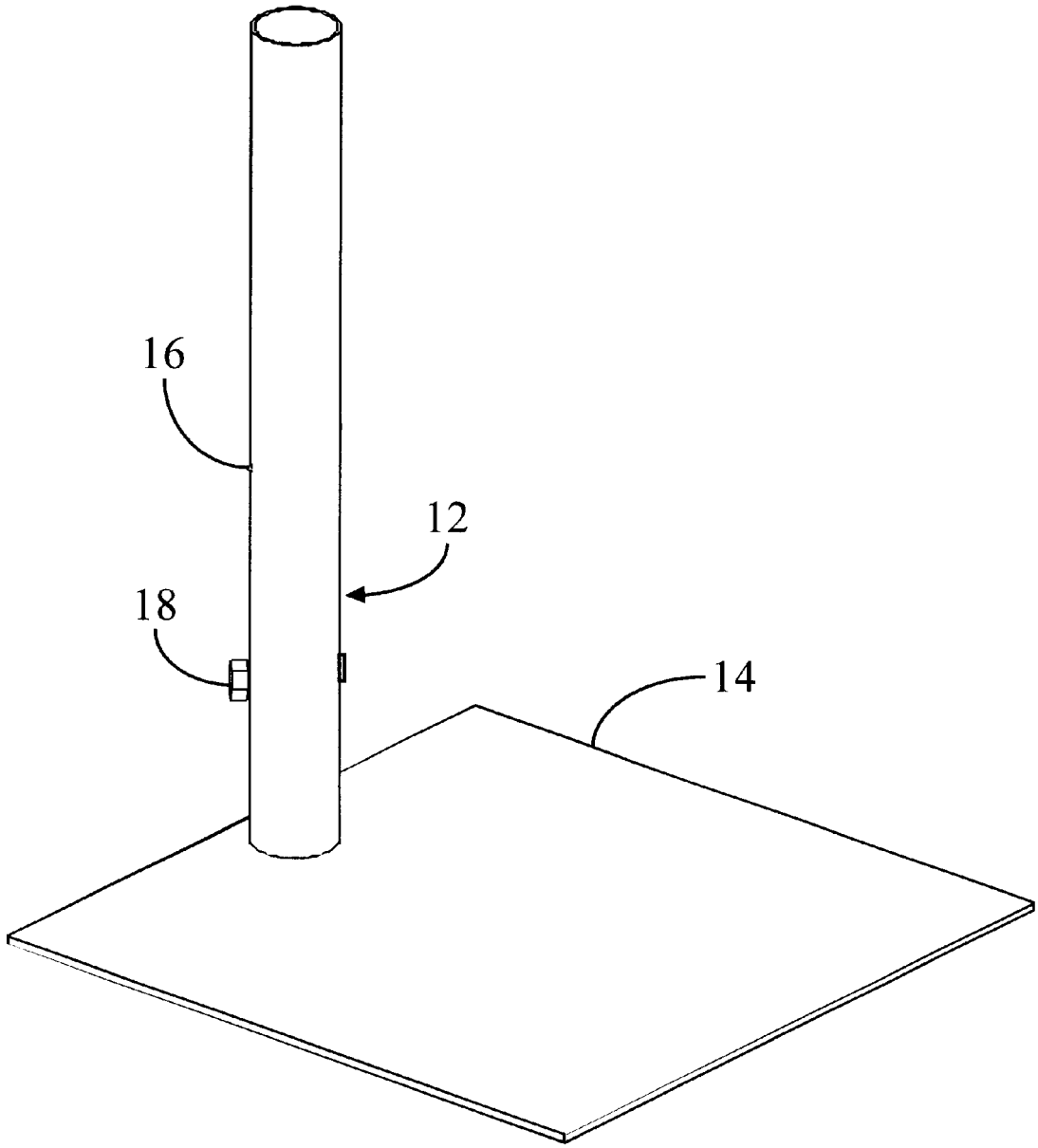
FIG. 12 is a perspective view of the base member of one embodiment of the invention.

As best seen in FIGS. 6, 9, and 11, a hub mechanism 48 is attached to the boom 24 at its far end. The mechanism 48 consists of two opposing triangular shaped angled plates 50 and 52, each having a plurality of holes 54. Each of the plates 50 and 52 are bent at an angle at a point approximately ⅓ distance from the apex, at that apex where is boom 24 is fastened. The angle is approximately 15 degrees. The holes 54 in the plate 50 are aligned with the holes in the plate 52, when the plates 50 and 52 are aligned with each other. The plates 50 and 52 are separated, or spaced apart by a plurality of rotating rib plugs 56, each of which has a bore 58 extending through it in a vertical direction. As seen in FIG. 9, each rib plug 56 has a cylindrical projection 60 extending outwardly from the side thereof. The projections 60 serve to receive the near end of cylindrical canopy support ribs 62 that extend radially outwardly from the hub mechanism 48. The cylindrical supporting ribs 62 are tubular, and the near end of each rib 62 fits over the corresponding projection 60 and is secured in a fixed, but not attached position. Thus, the supporting ribs 62 are movable to some extent with regard to the projections 60.

Rib 62*a* is connected to its respective rib plug projection 60 by a bungee cord 61.

Figure 10:
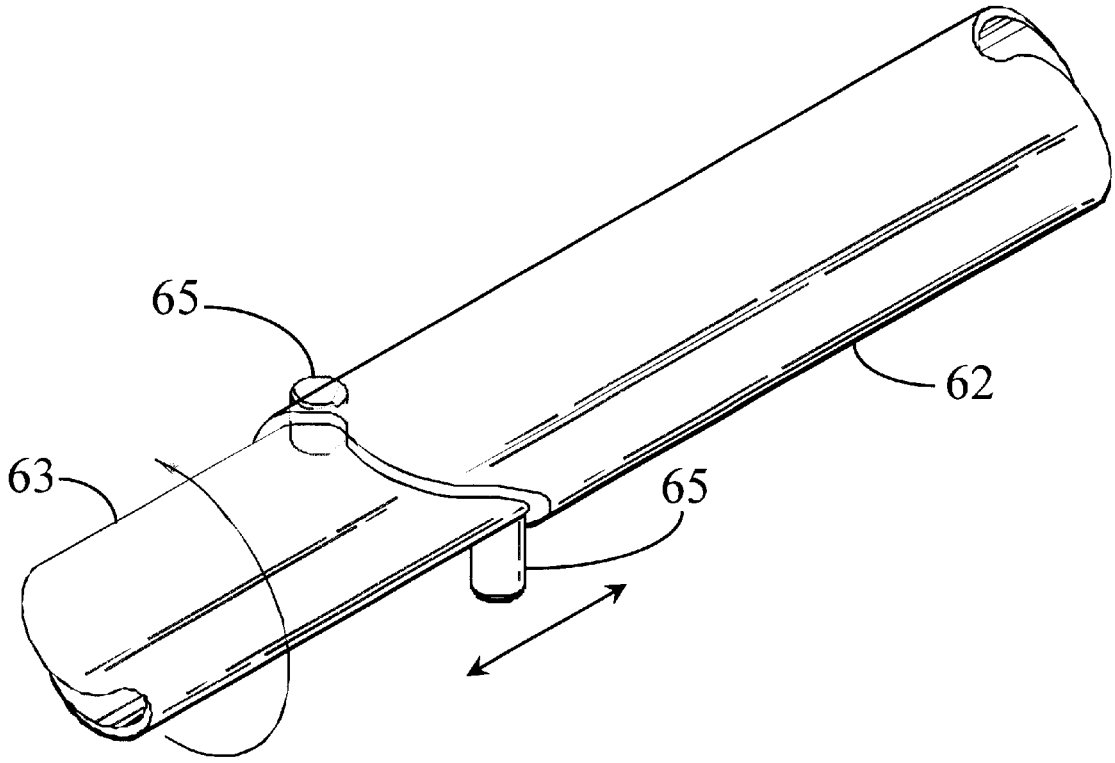
FIG. 10 is a perspective view, with parts cut away, illustrating the telescoping mechanism for the canopy support ribs.

As seen best in FIG. 10, the ribs 62 are telescoping ribs, and have an inner rib section 63 which telescopes within the rib 62, and which can be extended and fixed at a desired position by spring loaded buttons 65 affixed to the rib sections 63, which pop out of holes (not shown) in the rib 62.

The plates 50 and 52 are secured to each other by means of bolts 64, which extend through the holes 54 in each plate 50 and 52, and through the bores 58 in the rotating rib plugs 56. The bolts 64 are secured by nuts (not shown). Thus the rib plugs 56 are secured between the plates 50 and 52, but are free to rotate about a vertical axis.

As seen in FIGS. 6, and 11, the boom 24 is also fixed between the plates 50 and 52 by holes 66 drilled through the far end thereof, through which bolts 64 are threaded.

A boom support strut 68 is pivotably connected at its near end to the main mast 22, and pivotably connected at its far end to the boom 24, at a point which is intermediate the point of attachment of the boom 24 to the main mast 22, and the hub mechanism 48. Preferably, the support strut 68 is attached to the boom 24 at a point at least half of the length thereof.

Figure 5:
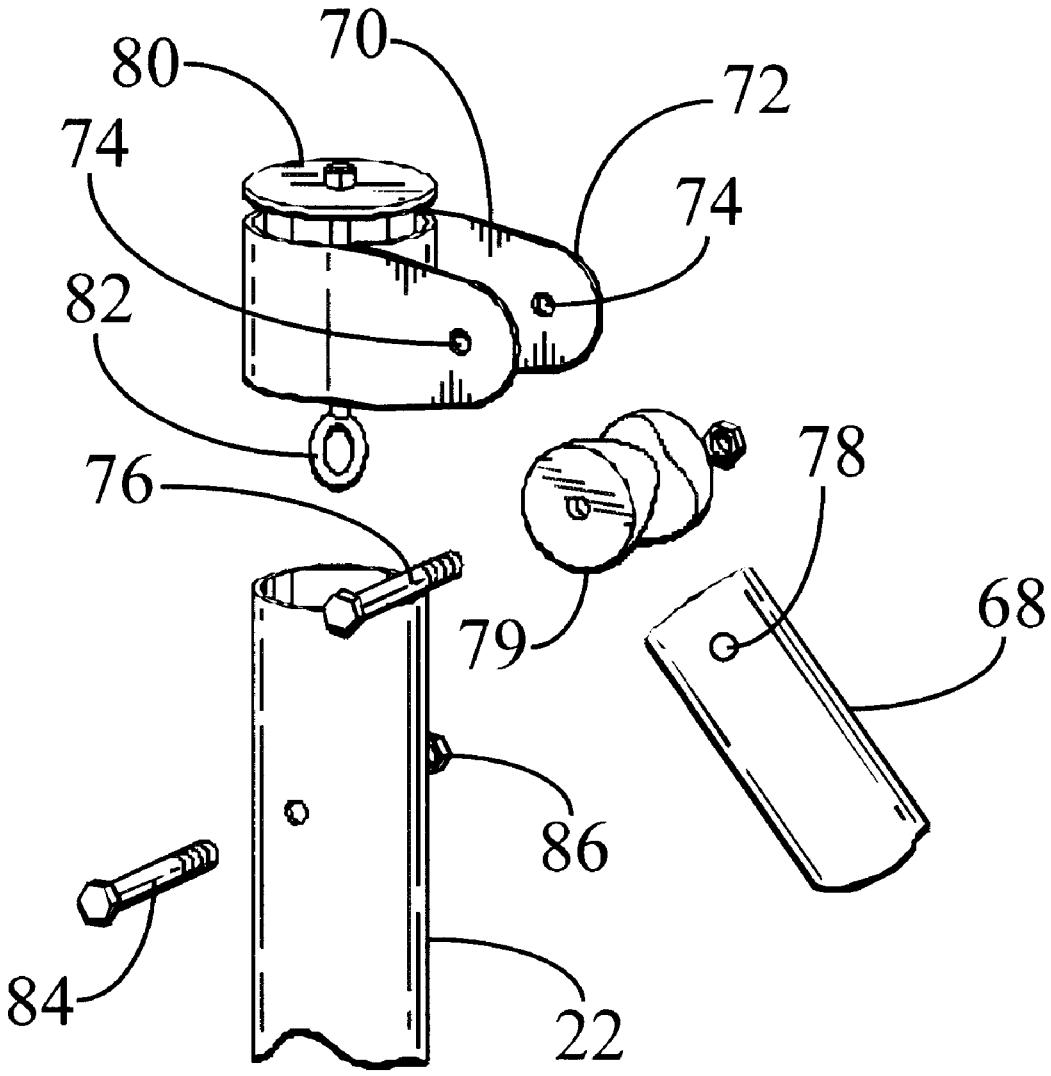
FIG. 5 is an exploded view of the mechanism for connecting the boom support strut to the top of the main mast.

As seen in FIG. 5, the support strut 68 is pivotably connected to the main mast 22, by means of a rotating strut collar 70 having extended ears 72, which fits around the main mast 22. Each ear 72 has a hole 74 drilled in it. The near end of the strut 68 is placed between the ears 72 of the collar 70, and a bolt 76 threaded through the ears, and through holes 78 in the end of the strut 68. A saddle 79 is positioned on each side of the support strut 68; intermediate it and the ears 72, to provide lateral support.

Thus the strut 68 is pivotable in a vertical direction about a horizontal axis.

The collar 70 is secured to the top of the main mast 22 by means of a rotating cap flange 80 through which an eyebolt 82 is threaded. The eye of the eyebolt 82 is held in place at the top of the main mast 22 by a bolt 84 which extends through holes in the mast 20, through the eye of the eye bolt 82, and is secured by a nut 86.

Figure 8:
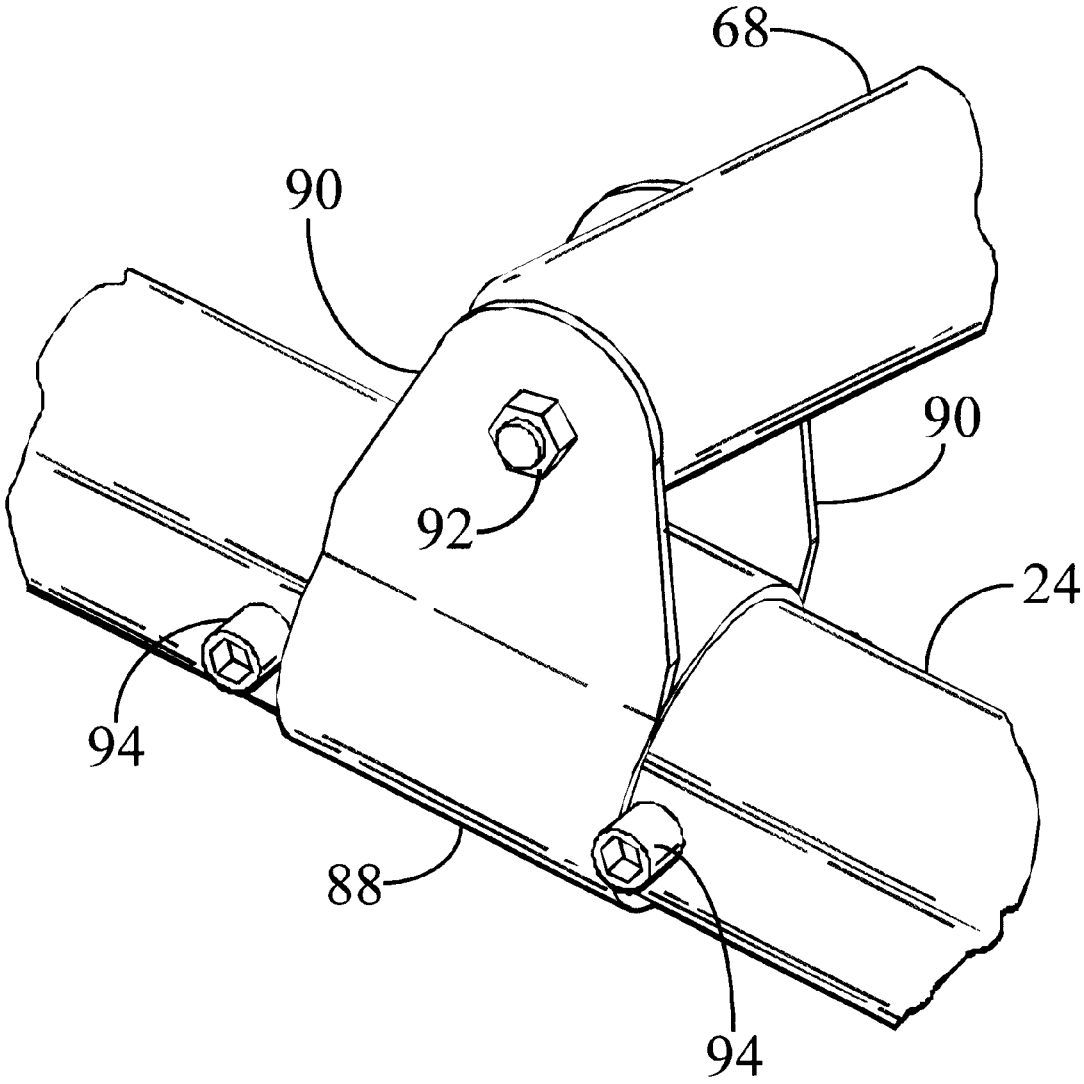
FIG. 8 is a perspective view, with parts broken away, showing the means for connecting the boom support strut to the boom.

As seen in FIG. 8, the far end of the boom support strut 68 is pivotably secured to the boom 24 by a rotating boom collar 88 which has ears 90 which extend from each side thereof. The ears 90 have holes drilled in them, as does the end of the strut 68 (not shown). A bolt and nut combination 92 extending through the holes in the ears, and the strut 68, pivotably secures the strut 68 to the boom 24.

Bolts secured by nuts 94 placed through holes (not shown) in the boom 24 on each side of the collar 88 hold the collar 88 in place on the boom 24. Thus the collar 88 is free to rotate around the boom 24.

A canopy 102 spans the support ribs 62, which, when extended, extend radially from the hub mechanism 48. As shown in FIGS. 1 and 3, the canopy 102 is rectangular in shape, but the shape is not critical. That is, it can be round, oval, square, rectangular, etc. The ribs 62 can be adjusted to accommodate any shape of canopy. It can be made out of any suitable material, although waterproof canvas is preferred. The canopy 102 has a slot 104 cut in it through which the boom support strut 68 passes from its point of connection to the mast 22, to the point of connection on the boom 24.

Pockets 106 are sewn into the underside of the canopy 102, and are adapted to receive the far ends 63 of the support ribs 62, after they are radially extended from the hub mechanism 48. The pockets 106 are formed of a piece of fabric, which is sewn to the underside of the canopy 102.

Thus, the ribs 62 are secured to the hub mechanism 48 at their near ends and to the canopy 102 by the pocket enclosures 106 at their far ends.

Figure 4:
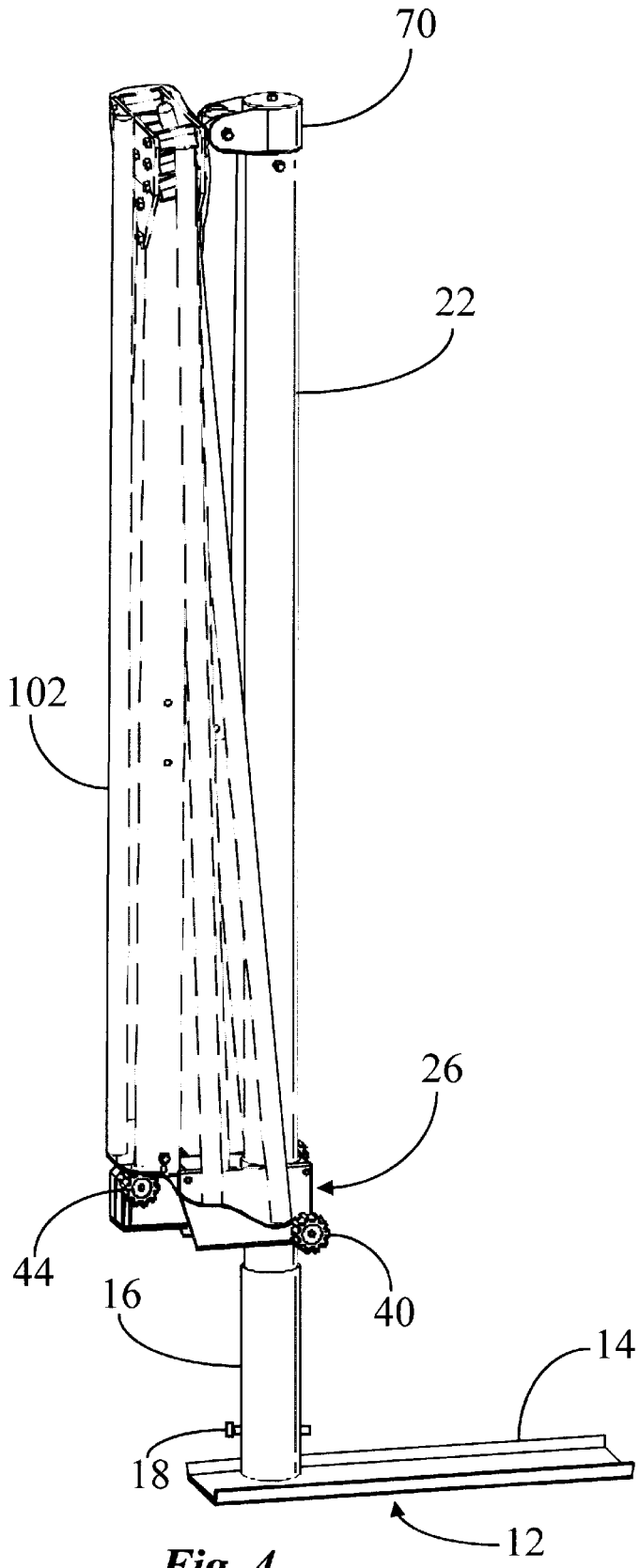
FIG. 4 is a side view of one embodiment of the sunshade of the invention showing it in folded position.

The canopy 102 of the sunshade can be raised or lowered, and its angle in relation to the sun changed, by raising or lowering the sliding mast clamp 26 attached to the main mast 22, and by pivoting and/or rotating the boom 24. As seen in FIG. 4, when the clamp 26 is lowered to the lowest point on the mast 22, the portable sunshade folds itself up, and is easily transportable. The relational aspect of the movable ribs 62 to the boom 24 enable the ribs 62 to be rotated so that they are aligned in parallel to each other and to the boom 24, thus permitting to entire canopy to be folded into a compact package.

When folding the sunshade up, it is necessary to disengage that rib 62*a* connected to the rib plug 56 situated opposite the apex of the triangular plates 50 and 52 to which the boom 24 is connected, in order to align it with the rest of the ribs folded in parallel to the boom 24. Disengaging the rib can do this, yet having it still connected to the hub by means of the bungee cord 61.

Figure 13:
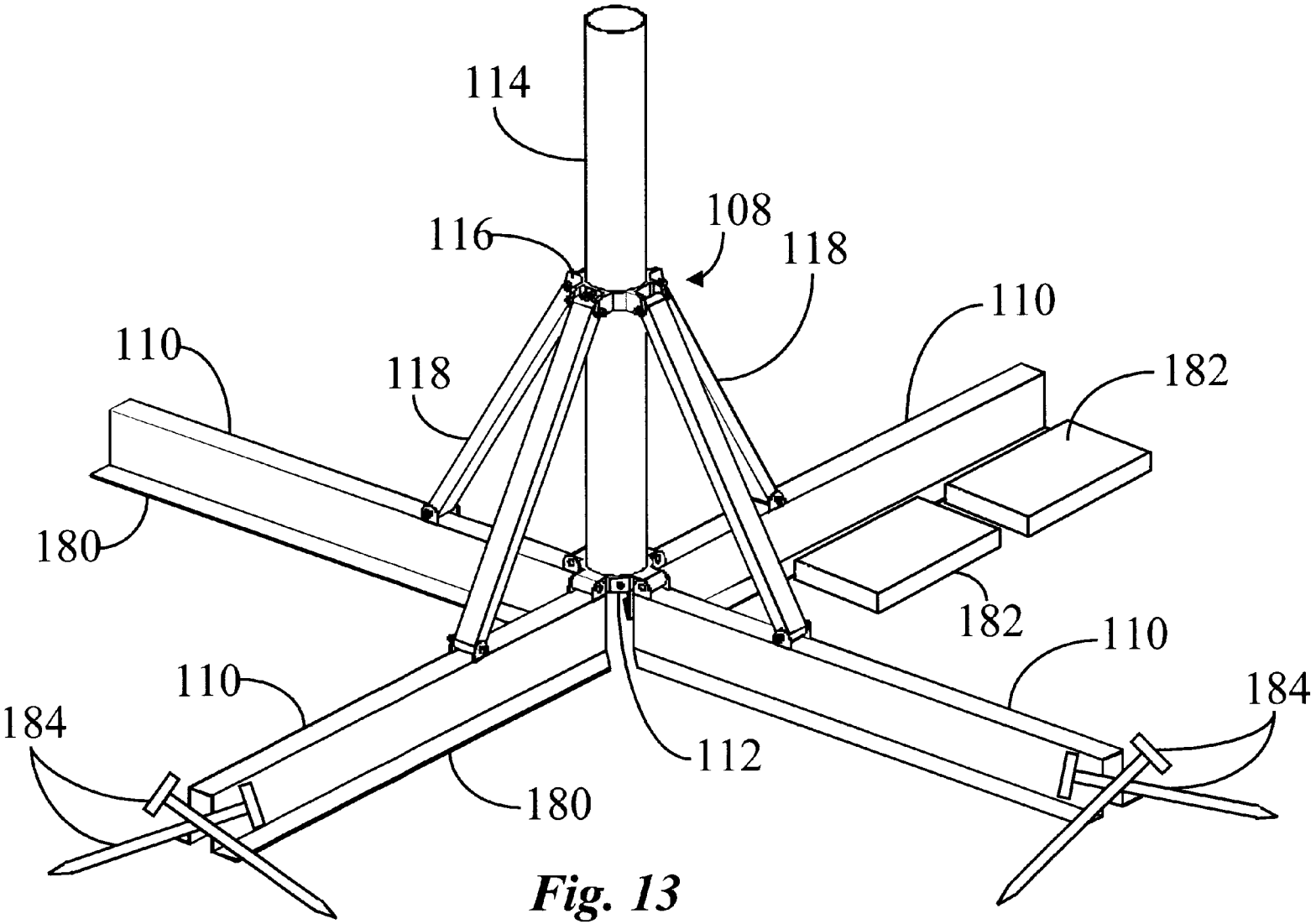
FIG. 13 is a perspective view of a foldable base of one embodiment of the invention.
Figure 14:
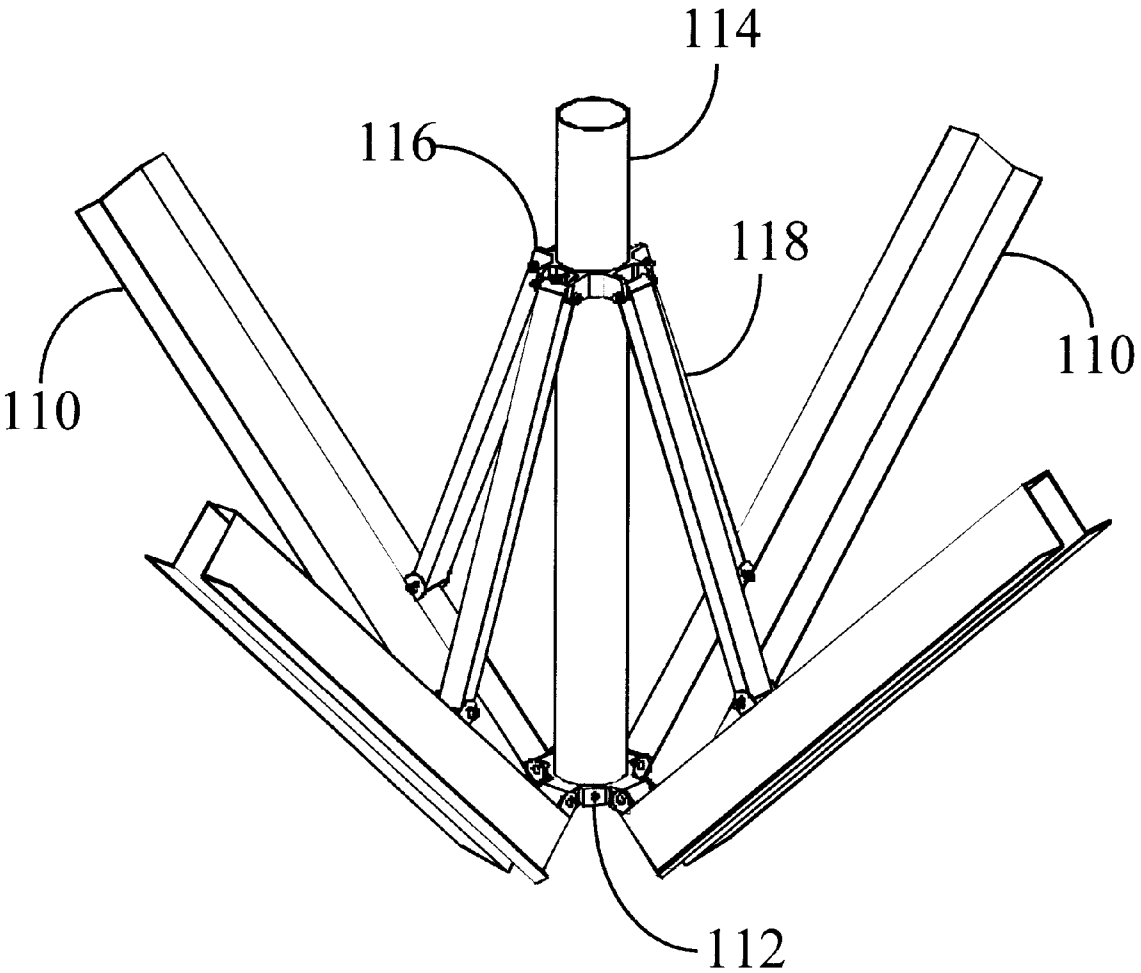
FIG. 14 is a perspective view of the foldable base of FIG. 13, partially folded.

Another embodiment of the invention is shown in FIGS. 13, and 14. As shown, the base member 108, which serves the same function as base member 12 in FIG. 3, comprises a plurality of radially extending elongated rails 110 which are pivotably connected to a collar 112 surrounding the base of the tubular post or column 114. The rails 110 have outwardly extending flanges 180 running along their lower sides. The collar 112 is fixed to the lower end of the column 114. Yet another collar 116 is slideably positioned on the column 114 and is moveable up and down in relation thereto.

A plurality of support struts 118 are pivotably connected to the collar 116 at one end, and pivotably connected to the rails 110 at a point intermediate the connection of the rails 110 to the collar 112 surrounding the column 118, and the outer end of the rails 110. The struts 118 thus serve to provide support to and stabilize the column 114 in a vertical position.

The upper collar 116 can be moved up and down in relation to the column 114. When it is moved upward, as seen in FIG. 14, the rails 110 are folded inward in the manner shown, so that the entire structure can then be compactly folded and transported.

The collar 116 is fixed in position by a cotter pin (not shown) which is placed through holes in the column at a point above the normal position of the collar 116 on the column 114, when the rails 110 are in extended position, as in FIG. 13.

Cement patio blocks 182 can be lain between the extended rails 110 with one edge overlying the flanges 180 to provide additional stabilizing weight.

The rails 110 can also be fixed to the ground at their ends by passing ground pins or stakes 184 through holes (not shown) in the ends of the rails, thence into the ground.

Figure 15:
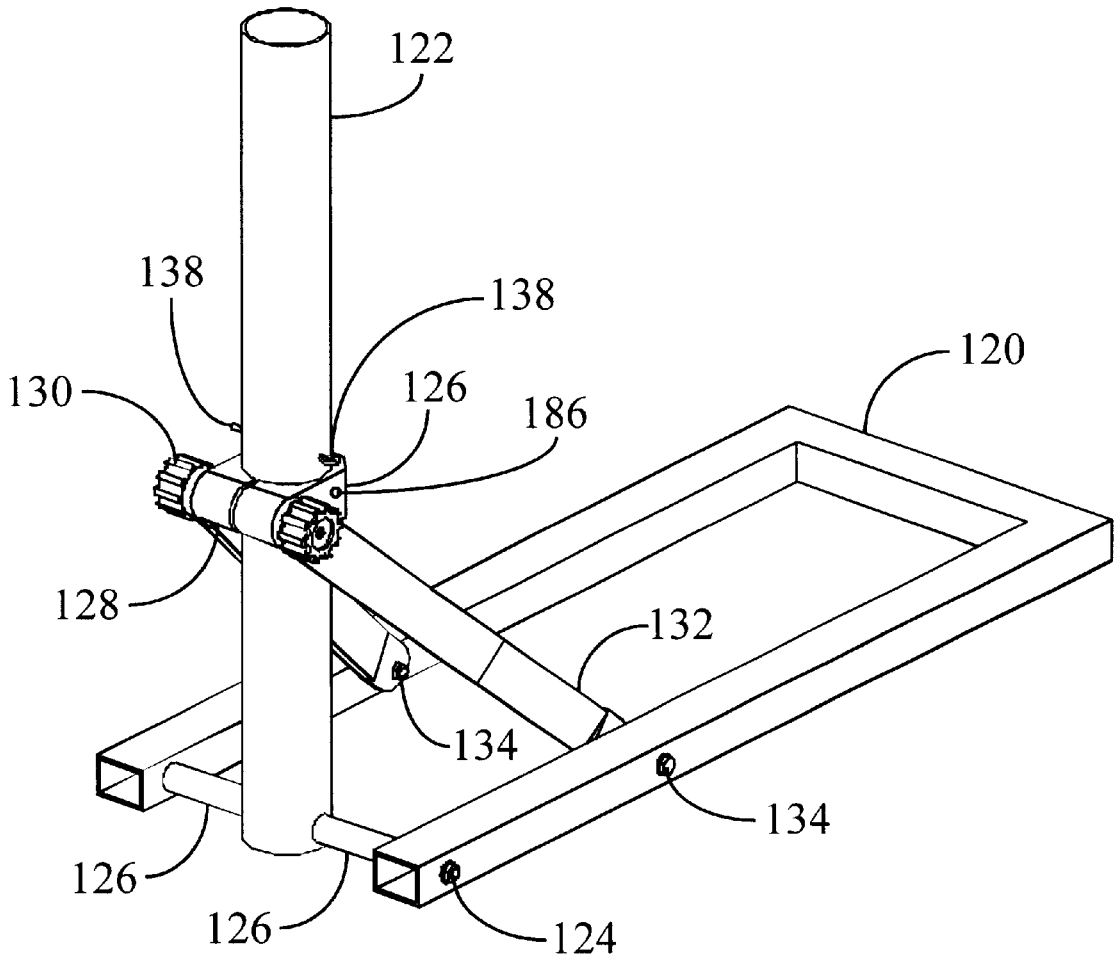
FIG. 15 is a perspective view of a base support for an alternative embodiment of the invention.

A further embodiment of the base support member is shown In FIG. 15. In this embodiment, a U-shaped base support frame 120 is attached to the lower end of a tubular vertical column 122 by a bolt 124 which extends through the support 122, through spacers 126 separating the support from the column 122, and through the column 122. The base support frame 120 is rotatable around the horizontal axis of the bolt 124. A slideable collar 126 is attached to the column 122 a short distance from its lower end.

Figure 16:
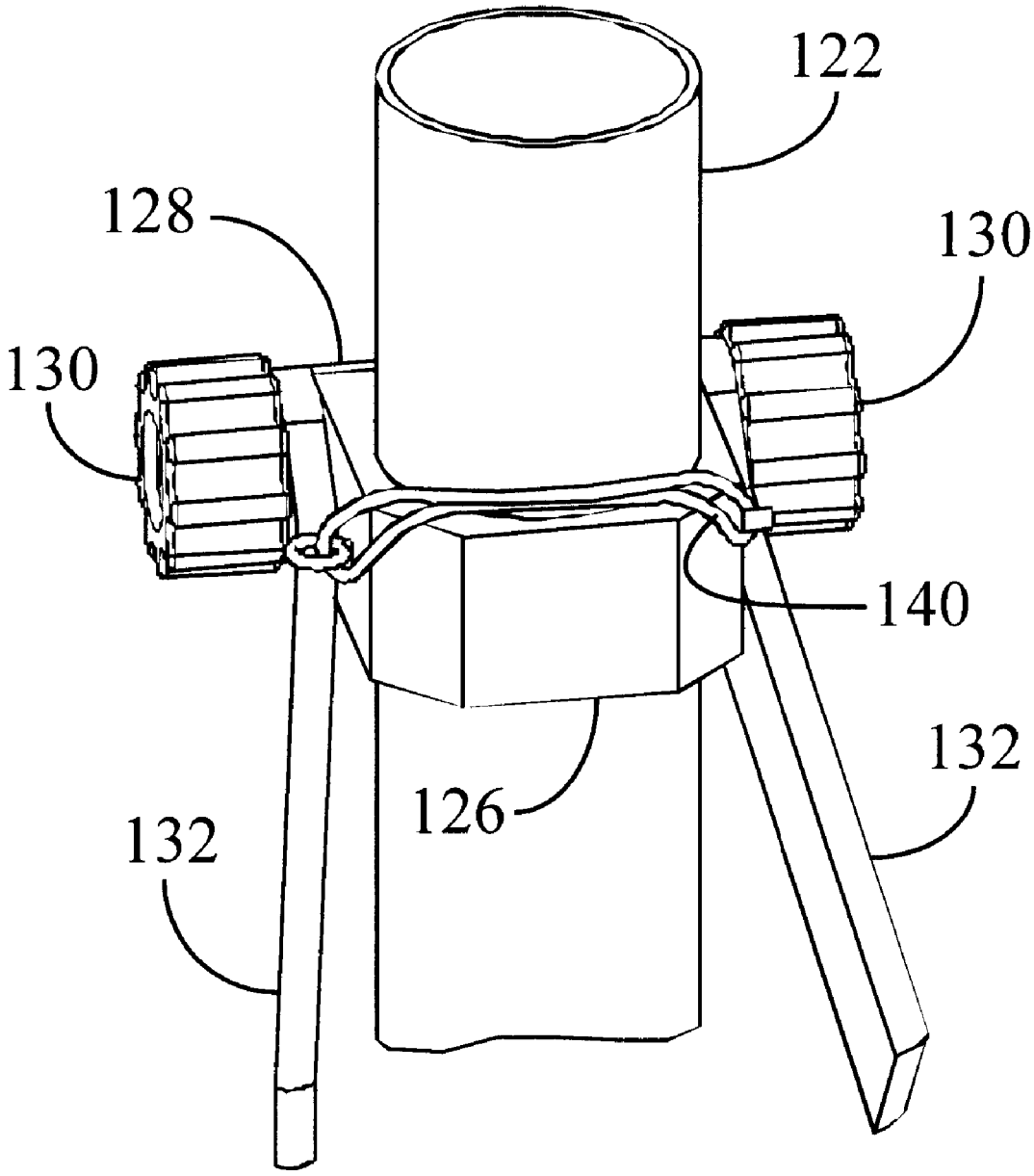
FIG. 16 is an enlarged view showing the means of connecting the support mast to the base member of an alternative embodiment of the invention.

The collar 126 surrounds column 122, and has ears 128, which extend outward on each side, each with a hole in it, not shown. Tightening knobs 130 connected to compressions bolts (not shown) which are placed in the ears 128, is used to bring the ears 128 into approximation around the column 122, securing it in place. A pair of support struts 132 connect the collar 126 to the base member 120. They are pivotably connected with respect to each. The support struts 132 are connected to the individual legs of the base member frame 120 by bolts 134, which extend through the leg, and through the struts 132. The struts 132 are pivotable around the bolt 134. A cotter pin 138 extending through holes in the column 122 and holes 186 in the collar 126 prevent the collar 126 from moving upward as pressure is placed on it by the weight of the sunshade. The cotter pin 138 is held in place by an elastic tie 140 (see FIG. 16).

The base support member 120 can be folded up against the column 122 by removing the cotter pin 138, loosening the collar 126, and allowing the collar 126 to move to a higher position on the column 122.

The base support member 120 should be sufficiently strong so as to support the weight of an automobile or other vehicle when its wheels are resting on the frame.

Figure 19:
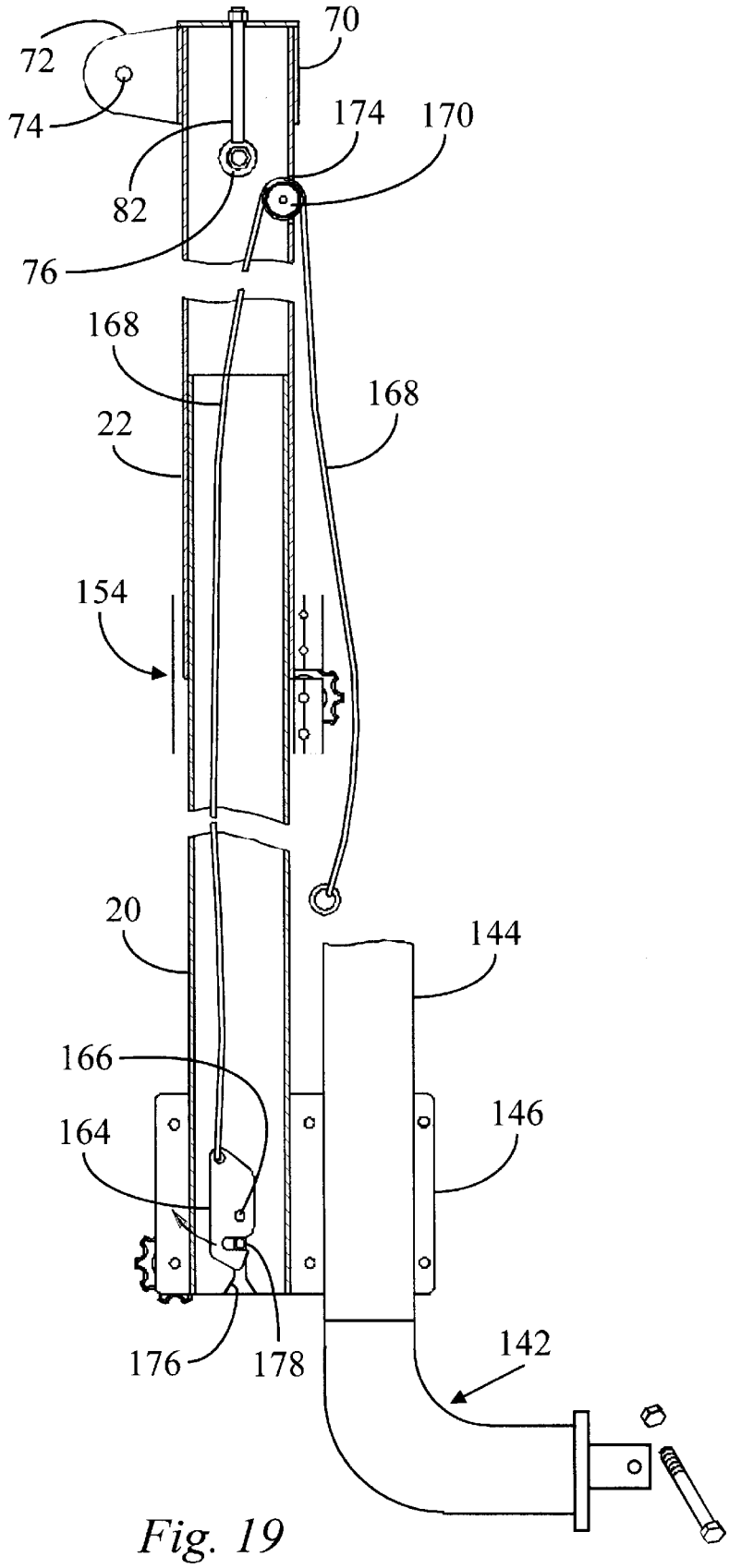
FIG. 19 is a cut away view of the mast structure of the sunshade of the invention showing the means for securing the lower mast to a utility rack or other device attached to the towing receiver on rear end of a SUV, truck or other vehicle.

In another embodiment of the invention, as shown in FIGS. 17–19, the sunshade is adapted for connection to a utility rack which is normally connected to the back of a SUV, or other motor vehicle, through a towing receiver or trailer hitch. As seen in FIG. 17, a utility rack 142 is attached to the back of a motor vehicle (not shown) by means of a hitching mechanism 190, and is secured with a bolt 192. The utility rack 142 has an upwardly projecting cylindrical column 144.

A clamp 146 is fitted around the upwardly projecting utility rack column 144 and the lower end of telescoping vertical mast 20 of the sunshade 10. The clamp 146 comprises opposing blocks 148, 150, which are shaped on the inside so as to conform to the shape of the utility rack column 144 and the sunshade mast 20, in parallel. The clamp 146 is tightened around the column 144, and mast 20, by means of compression bolt knobs 152, which are attached to compression bolts, which extend through holes in the blocks 148, 150.

A second clamp 154 connects the main mast 22 to the lower mast 20 of the sunshade. The clamp 154 is substantially identical to others, which has been used, and comprises a block 156 having upper and lower ears on each side 158, 160, which project outwardly. The clamp 154 is tightened around the masts 22 and 20 by means of compression screws extending through opposing ears, and which are tightened by means of the knobs 162 affixed to the compression screws. As the knobs are tightened around the compression bolts, the ears are drawn closer to each other around the masts, and fixes the masts in position, thereby allowing telescoping height adjustment of the shade.

As seen in FIG. 19, the sunshade mast 20 is also locked in place by means of a lever 164, which axially rotates around a bolt 166 extending through the clamp 146 and the lower mast 20. The lever 164 is attached to a rope 168 which extends up through the interior cavities of the lower mast 20 and main mast 22, over a pulley 170 mounted at the upper end of the upper mast 22, thence through a hole 174 in the mast 22, to the outside.

The lower end of the lower mast 20 is notched 176, and thus fits over a pin 178 extending through the clamp 146. When the lower mast 20 is lowered into place in the clamp 146, the lever 164 engages the pin 178, and the mast 20 is thus locked into position. The same locking mechanism is used to lock the mast 20 to all types of base members.

When it is desired to remove the sunshade, the rope 168 is pulled from the outside; the lever 164 is rotated around the pin 166, and disengages. The lower mast 20 and the balance of the sunshade can then be removed after the clamp 146 is loosened.

When the sunshade is taken on a camping trip, or is used in connection with travel with a motor home, it is necessary to provide stability to the base. This can be done by attaching the mast 20 to a preexisting support, as described above in connection with a utility support carrier, or in an alternative embodiment, by placing a weight on the horizontally extending support frame or plate 14. This can be accomplished by positioning it underneath the wheels of an automobile, truck, or mobile home. This supplies more than enough weight to counterbalance the weight of the canopy, main masts, supporting struts, ribs, etc.

The weight can also be supplied, as mentioned before, by placing the plate 14 underneath the edge of a hot tub or Jacuzzi.

This invention thus encompasses the use of an automobile, truck, travel trailer or other vehicle to provide the counterbalancing weight on the support frame needed to stabilize the sunshade, and the use of a hot tub or Jacuzzi for the same purpose.

It will be apparent to those skilled in the art that various modifications can be made in the sunshade of this invention, yet will be within the spirit and scope of the invention, being limited solely by the appended claims.

What is claimed is:

1. A portable sunshade comprising:

a mast extending in a generally vertical direction;

a boom collar engaging the mast;

a boom having a first and second end and a longitudinal axis, the boom engaging the collar at the first end;

a canopy assembly attached to the boom at a position away from the first end toward the second end, including a hub having a plurality of radial ribs to support the canopy; and a support structure attached to the mast at a lower end thereof to support the mast, the support structure including a generally horizontally extending coupling adapted to engage a vehicle trailer hitch extension bar.

2. The portable sunshade of claim 1 wherein the radial ribs are pivotable around the hub to fold the canopy against the boom.

3. The portable sunshade of claim 2 wherein the radial ribs and the boom lie substantially in the same plane.

4. The portable sunshade of claim 1 wherein the canopy assembly attaches at the second end of the boom.

5. The portable sunshade of claim 1 wherein the hub comprises a pair of opposing plates spaced apart by rib plugs, and the ribs pivot with the rib plugs.

6. The portable sunshade of claim 1 wherein the mast comprises an assembly of telescoping tubes, such that the height of the mast may be adjusted.

7. The portable sunshade of claim 1 wherein the boom collar is configured to slide vertically upon and to rotate about the mast, and includes a clamping mechanism to allow clamping to the mast.

8. The portable sunshade of claim 1 wherein the boom collar includes a mechanism configured to allow the boom to be rotated about its own longitudinal axis, and to clamp the boom in its rotary position.

* * * * *